US008159423B2

(12) United States Patent
Choi

(10) Patent No.: US 8,159,423 B2
(45) Date of Patent: Apr. 17, 2012

(54) ORGANIC LIGHT EMITTING DISPLAY DEVICE

(75) Inventor: Sang-Moo Choi, Yongin (KR)

(73) Assignee: Samsung Mobile Display Co., Ltd., Yongin (KR)

( * ) Notice: Subject to any disclaimer, the term of this patent is extended or adjusted under 35 U.S.C. 154(b) by 587 days.

(21) Appl. No.: 12/405,004

(22) Filed: Mar. 16, 2009

(65) Prior Publication Data

US 2009/0309816 A1 Dec. 17, 2009

(30) Foreign Application Priority Data

Jun. 11, 2008 (KR) ..... 10-2008-0054547

(51) Int. Cl.
*G09G 3/30* (2006.01)
*G09G 3/32* (2006.01)

(52) U.S. Cl. ..... 345/76; 345/82; 345/92; 315/169.3

(58) Field of Classification Search ..... 345/76, 345/82, 92; 315/169.3
See application file for complete search history.

(56) References Cited

U.S. PATENT DOCUMENTS

| | | | | |
|---|---|---|---|---|
| 7,580,015 | B2 * | 8/2009 | Tai et al. | 345/82 |
| 7,800,556 | B2 * | 9/2010 | Chen et al. | 345/76 |
| 2006/0221005 | A1 * | 10/2006 | Omata et al. | 345/76 |

FOREIGN PATENT DOCUMENTS

| | | | |
|---|---|---|---|
| JP | 2004-302288 | | 10/2004 |
| JP | 2007-65015 | | 3/2007 |
| JP | 2007-253505 | | 10/2007 |
| KR | 1020060043679 | A | 5/2006 |
| KR | 10-2006-0128464 | | 12/2006 |
| KR | 10-2008-0007254 | | 1/2008 |
| KR | 1020080056923 | A | 6/2008 |
| KR | 1020080084017 | A | 9/2008 |
| KR | 1020080091926 | A | 10/2008 |

OTHER PUBLICATIONS

KIPO Office action dated Dec. 29, 2009 for the corresponding Korean Priority Application No. 10-2008-0054547.

* cited by examiner

*Primary Examiner* — Quan-Zhen Wang
*Assistant Examiner* — Michael J Eurice
(74) *Attorney, Agent, or Firm* — Christie, Parker & Hale, LLP

(57) ABSTRACT

An organic light emitting display device that is capable of compensating for deterioration of organic light emitting diodes includes: a scan driver driving scan lines, compensation control lines, and light emission control lines; a data driver supplying initialization voltage to data lines during a first subperiod of a horizontal period and supplying data signals to the data lines during a second subperiod of the horizontal period; and pixels positioned at crossing areas of the scan lines and the data lines. Each pixel includes: an organic light emitting diode; a pixel circuit including a driving transistor controlling current flowing through the organic light emitting diode; and a compensation unit adjusting voltage of the gate electrode of the driving transistor based on deterioration of the organic light emitting diode. The compensation unit includes a transistor and a capacitor serially coupled between the gate and source of the driving transistor.

17 Claims, 6 Drawing Sheets

ORGANIC LIGHT EMITTING DISPLAY DEVICE

CROSS-REFERENCE TO RELATED APPLICATIONS

This application claims priority to and the benefit of Korean Patent Application No. 10-2008-0054547, filed on Jun. 11, 2008, in the Korean Intellectual Property Office, the entire content of which is incorporated herein by reference.

BACKGROUND

1. Field of the Invention

The present invention relates to an organic light emitting display device, and in particular to an organic light emitting display device with compensation for deterioration of light emitting elements.

2. Discussion of Related Art

Recently, flat panel display devices of reduced weight and volume have been developed. Flat panel display device types include liquid crystal display devices, field emission display devices, plasma display panels, and organic light emitting display devices. Organic light emitting display devices display an image using organic light emitting diodes, which generate light by recombination of electrons and holes. Organic light emitting display devices have rapid response speeds and low power consumption.

FIG. 1 is a circuit diagram showing a pixel of a conventional organic light emitting display device. The pixel 4 of the conventional organic light emitting display device includes an organic light emitting diode OLED and a pixel circuit 2 coupled to a data line Dm and a scan line Sn to control the organic light emitting diode OLED.

An anode electrode of the organic light emitting diode OLED is coupled to a pixel circuit 2, and a cathode electrode of the organic light emitting diode OLED is coupled to a second power supply ELVSS. The organic light emitting diode OLED generates light with a brightness corresponding to current supplied from the pixel circuit 2.

When a scan signal is asserted on the scan line Sn, the pixel circuit 2 receives a data signal from the data line Dm to control an amount of current supplied to the organic light emitting diode OLED. To accomplish this, the pixel circuit 2 includes a first transistor M1", a second transistor M2", and a storage capacitor Cst. The second transistor M2" is coupled between a power supply ELVDD and the organic light emitting diode OLED. The first transistor M1" is coupled between the second transistor M2" and the data line Dm and the scan line Sn. The storage capacitor Cst is coupled between a gate electrode and a source electrode of the second transistor M2".

A gate electrode of the first transistor M1" is coupled to the scan line Sn, and a first electrode of the first transistor M1" is coupled to the data line Dm. A second electrode of the first transistor M1" is coupled to a terminal of the storage capacitor Cst. The first electrode may be designated a source electrode or a drain electrode and the second electrode designated a drain electrode or a source electrode respectively. Formally, the designation of source electrode refers to the source of carriers in a transistor; however, transistor M1" operates as a pass transistor so that there is no substantial distinction between source and drain. Hereinafter, "source electrode" or "drain electrode" will be used without elaboration. Those skilled in the art will appreciate the symmetry, general interchangeability, and accept the nomenclature for its conciseness. When the scan signal is asserted on the scan line Sn, first transistor M1" is turned on to supply the data signal from the data line Dm to the storage capacitor Cst. The storage capacitor Cst is charged to a voltage corresponding to the data signal.

The gate electrode of second transistor M2" is coupled to a terminal of the storage capacitor Cst, and the source electrode of second transistor M2" is coupled to the other terminal of the storage capacitor Cst and the first power supply ELVDD. A drain electrode of second transistor M2" is coupled to the anode electrode of the organic light emitting diode OLED. The second transistor M2" controls an amount of current flowing from the first power supply ELVDD to the second power supply ELVSS through the organic light emitting diode OLED. The current corresponds to a voltage value stored in the storage capacitor Cst. The organic light emitting diode OLED generates light corresponding to the amount of current supplied from the second transistor M2".

This conventional organic light emitting display suffers from reduced brightness over time. In other words, as the organic light emitting diode OLED deteriorates with time, the organic light emitting display device no longer displays an image with the desired brightness.

SUMMARY OF THE INVENTION

Therefore, it is an aspect of the present invention to provide an organic light emitting display device capable of compensating for deterioration of an organic light emitting diode.

An embodiment of the present invention provides an organic light emitting display device, including: a scan driver configured to drive scan lines, first control lines, and light emission control lines; a data driver configured to supply initialization voltages to data lines during a first subperiod of a horizontal period and configured to supply data signals to the data lines during a second subperiod of the horizontal period; and pixels positioned at crossing areas of the scan lines and the data lines, each of the pixels including: an organic light emitting diode; a pixel circuit including a first transistor for controlling an amount of current flowing from a first power supply through the organic light emitting diode to a second power supply, the first transistor configured to receive the initialization voltage at its gate electrode during the first subperiod; and a compensation unit coupled between the gate electrode and a source electrode of the first transistor, the compensation unit configured to control voltage at the gate electrode of the first transistor corresponding to a deterioration of the organic light emitting diode, the compensation unit including a second transistor and a first capacitor serially coupled between the gate electrode and the source electrode of the first transistor.

Another embodiment of the present invention provides an organic light emitting display device, including: a plurality of pixels, each of the pixels coupled to a first power source, a second power source, a scan line for receiving a scan signal, a control line for receiving a control signal, a data line for receiving data voltages and initialization voltages, and an emission control line for receiving emission control signals, and each of the pixels including: an organic light emitting diode coupled to the second power source; a compensation unit including a first storage element for storing a first voltage of a voltage difference between the initialization voltage and a voltage across the organic light emitting diode; and a pixel circuit including a second storage element for storing the data voltages and a drive transistor coupled to the organic light emitting diode, wherein the first storage element and the second storage element are coupled in parallel in response to the emission control signal and the control signal between a first electrode and a gate electrode of the drive transistor, such that a current flowing in the organic light emitting diode is based on both the data voltage and the stored voltage across the organic light emitting diode.

Yet another embodiment of the present invention provides an organic light emitting display device, including: a plurality of pixels, each of the pixels coupled to a first power source, a second power source, a scan line for receiving a scan signal, a first control line for receiving a first control signal, a second control line for receiving a second control signal, a data line for receiving data voltages and initialization voltages, an $i^{th}$ emission control line for receiving emission control signals, and an $i+1^{th}$ emission control line for receiving the emission control signals, and each of the pixels including: an organic light emitting diode coupled to the second power source; a compensation unit including a first storage element for storing a first voltage of a voltage difference between the initialization voltage and a voltage across the organic light emitting diode; and a pixel circuit including a drive transistor coupled to the organic light emitting diode and a second storage element for storing a second voltage of a voltage difference between the data voltage and a threshold voltage of the drive transistor wherein the first storage element and the second storage element are coupled in parallel in response to the $i^{th}$ emission control signal and the $i+1^{th}$ emission control signal between a first electrode and a gate electrode of the drive transistor, such that a current flowing in the organic light emitting diode is based on the data voltage, the stored voltage across the organic light emitting diode, and the stored threshold voltage of the drive transistor.

BRIEF DESCRIPTION OF THE DRAWINGS

The accompanying drawings, together with the specification, illustrate exemplary embodiments of the present invention and, together with the description, serve to explain the principles of the present invention.

DETAILED DESCRIPTION

Figure 1:
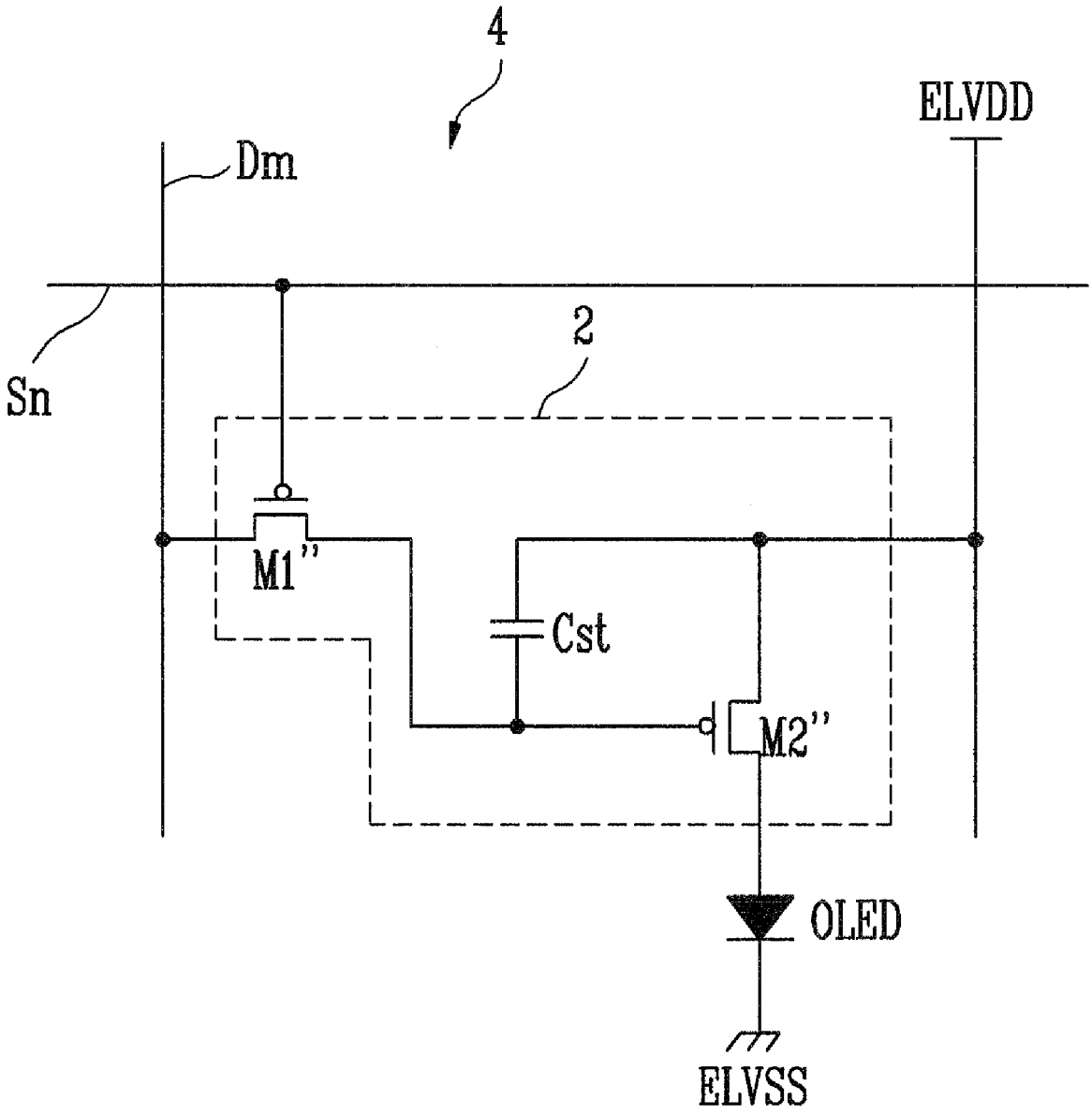
FIG. 1 (PRIOR ART)
FIG. 1 illustrates a conventional pixel of an organic light emitting display device.

In the following detailed description, only certain exemplary embodiments of the present invention have been shown and described, simply by way of illustration. As those skilled in the art would realize, the described embodiments may be modified in various different ways, all without departing from the spirit or scope of the present invention. Accordingly, the drawings and description are to be regarded as illustrative in nature and not restrictive. Like reference numerals designate like elements throughout the specification.

Throughout this specification and the claims that follow, when an element is described as being coupled to another element, it may be directly coupled to the another element or may be indirectly coupled to the another element with one or more intervening elements interposed therebetween. Further, some of the elements that are not essential to a complete understanding of the invention are omitted for clarity.

Figure 2:
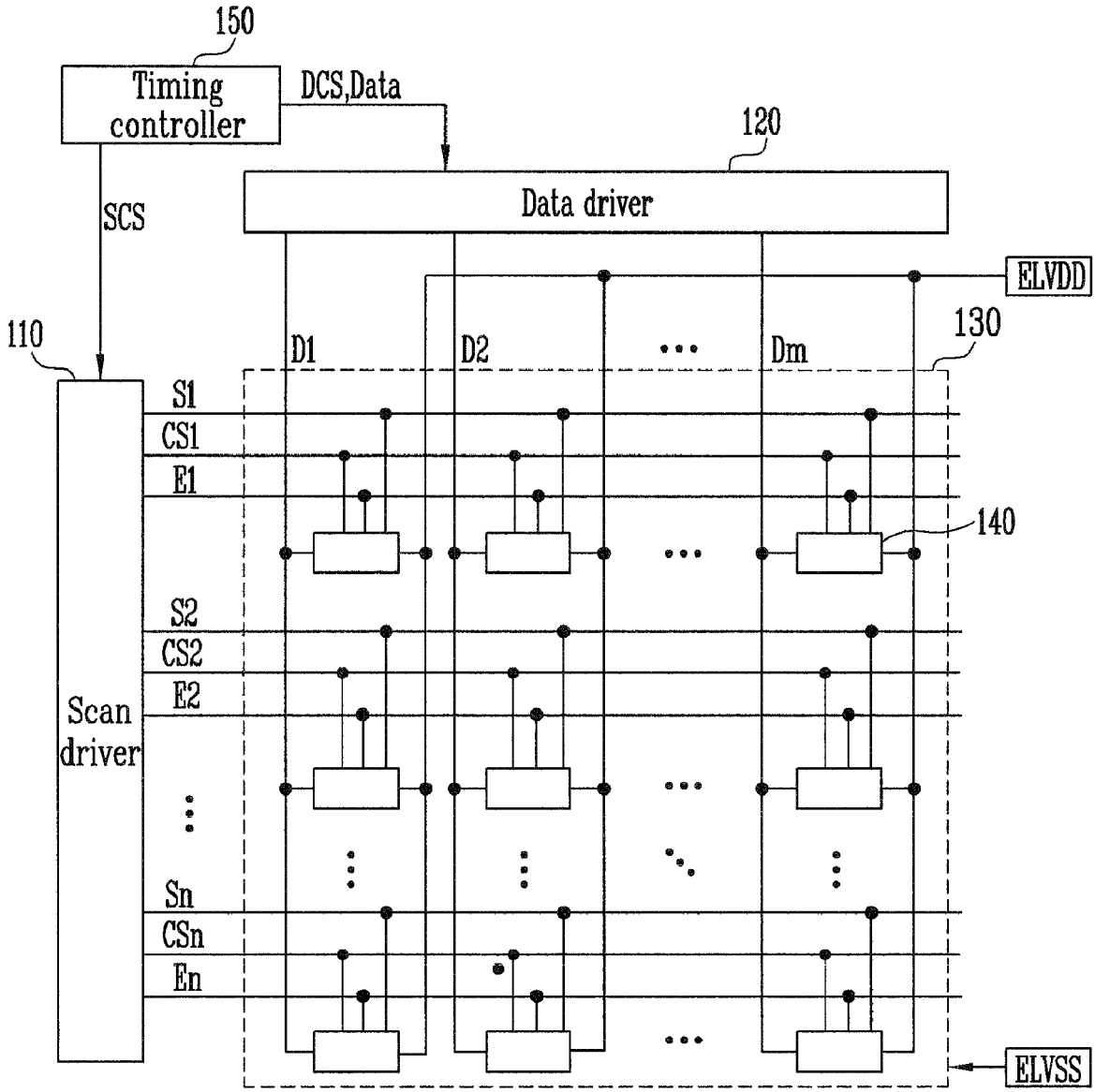
FIG. 2 is a schematic structural view of an organic light emitting display device according to aspects of the present invention.

FIG. 2 illustrates an organic light emitting display device according to aspects of the present invention. As shown in FIG. 2, the organic light emitting display device includes a display area 130, a scan driver 110, a data driver 120, and a timing controller 150.

The display area 130 is coupled to the scan driver 110 by scan lines S1 to Sn, light emission control lines E1 to En, and compensation control lines CS1 to CSn. The display area 130 is coupled to the data driver 120 by data lines D1 to Dm. The display area 130 includes a plurality of pixels 140 positioned at areas where the scan lines S1 to Sn, the light emission control lines E1 to En, and the compensation control lines CS1 to CSn cross the data lines D1 to Dm. The pixels 140 receive a first power supply ELVDD and a second power supply ELVSS. Each pixel 140 includes an organic light emitting diode. The pixels 140 control a current through the organic light emitting diode corresponding to a data signal. The current is supplied from the first power supply ELVDD and sunk by the second power supply ELVSS. Light with a brightness corresponding to the current is generated by the organic light emitting diode. While the display area 130 is depicted as having a very few signal lines for illustrative purposes, in practice, the display area 130 would typically include many hundreds of the lines in both row and column directions, as those skilled in the art would appreciate. Of course, an appropriate number of driving circuits would be provided to drive such signal lines.

The timing controller 150 controls the scan driver 110 and the data driver 120. The timing controller 150 generates a data driver control signal DCS and a scan driver control signal SCS corresponding to synchronization signals received by the timing controller 150. The data driver control signal DCS generated in the timing controller 150 is supplied to the data driver 120 and the scan driver control signal SCS generated in the timing controller 150 is supplied to the scan driver 110. The timing controller 150 arranges data it receives and transfers them to the data driver 120.

The scan driver 110 drives the scan lines S1 to Sn, the light emission control lines E1 to En, and the compensation control lines CS1 to CSn. The scan driver 110 receives the scan driver control signal SCS and supplies signals to the scan lines S1 to Sn, the light emission control lines E1 to En, and the compensation control lines CS1 to CSn. The scan driver 110 sequentially supplies scan signals to the scan lines S1 to Sn and sequentially supplies light emission control signals to the light emission control lines E1 to En. The scan driver 110 also sequentially supplies compensation control signals to the compensation control lines CS1 to CSn. The scan driver supplies the signals to each of the corresponding lines during a horizontal period. Each horizontal period includes a first subperiod that precedes a second subperiod. In some embodiments, the first subperiod is set to be the same or shorter than the second subperiod. The function and timing of the signals will be described in detail below.

The data driver 120 drives the data lines D1 to Dm. The data driver 120 receives the data driver control signal DCS and the arranged data from the timing controller 150. The data driver 120 generates data signals and supplies them to the pixels 140 via the data lines D1 to Dm. The data driver 120 also supplies an initialization voltage for use in deterioration compensation.

Figure 3:
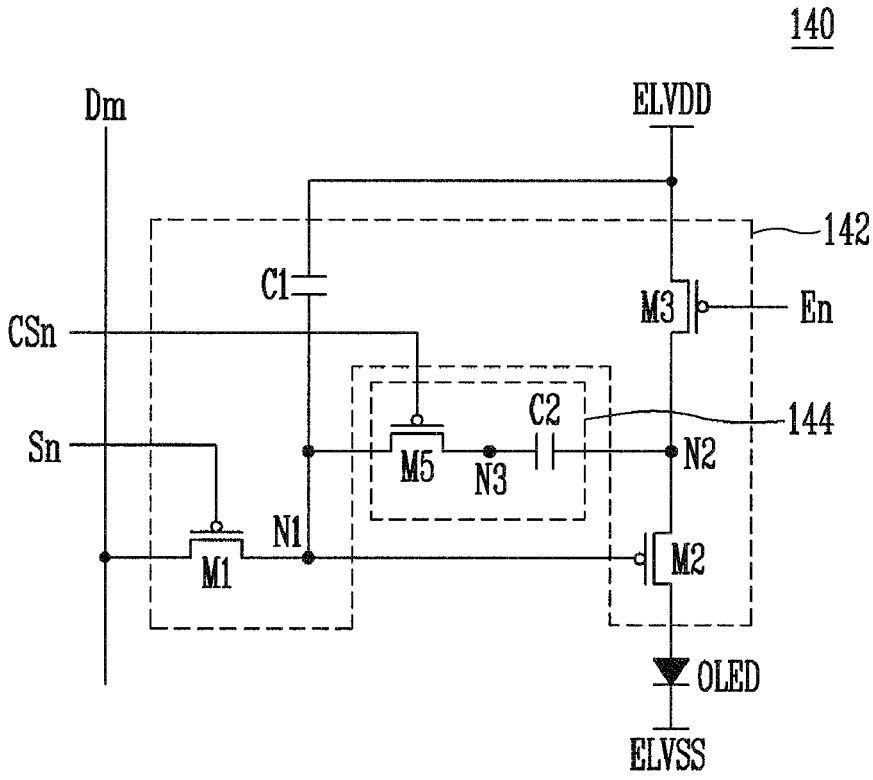
FIG. 3 is a schematic view of an embodiment of a pixel of the organic light emitting display device shown in FIG. 2.

FIG. 3 illustrates an embodiment of a pixel of the organic light emitting display shown in FIG. 2. The pixel shown in FIG. 3 is coupled, for convenience of explanation, to an $n^{th}$ scan line Sn and an $m^{th}$ data line Dm. The pixel 140 includes an organic light emitting diode OLED, a pixel circuit 142 controlling current supplied to the organic light emitting diode OLED, and a compensation unit 144 for compensating for deterioration of the organic light emitting diode OLED.

An anode electrode of the organic light emitting diode OLED is coupled to the pixel circuit 142, and a cathode electrode of the organic light emitting diode OLED is coupled to the second power supply ELVSS. The organic light emitting diode OLED generates light with a brightness corresponding to a current supplied from the pixel circuit 142.

The pixel circuit 142 controls the amount of current supplied to the organic light emitting diode OLED. The pixel circuit 142 includes a first transistor M1, a second transistor M2, a third transistor M3, and a first capacitor C1. A gate electrode of the first transistor M1 is coupled to the $n^{th}$ scan line Sn, and a drain electrode of the first transistor M1 is coupled to the $m^{th}$ data line Dm. A source electrode of the first transistor M1 is coupled to a gate electrode (that is, a first node N1) of the second transistor M2. First transistor M1 is turned on when the scan signal is asserted on the scan line Sn.

The gate electrode of the second transistor M2 is coupled to the first node N1, and a source electrode of the second transistor M2 is coupled to a drain electrode (that is, a second node N2) of the third transistor M3. Further, a drain electrode of the second transistor M2 is coupled to the anode electrode of the organic light emitting diode OLED. The second transistor M2 controls the amount of current flowing from a first power supply ELVDD to the second power supply ELVSS through the organic light emitting diode OLED and corresponding to a voltage applied to the first node N1. In the shown embodiment, the first power supply ELVDD operates with a voltage value higher than that of the second power supply ELVSS.

A gate electrode of the third transistor M3 is coupled to an $n^{th}$ light emission control line En and a source electrode of the third transistor M3 is coupled to the first power supply ELVDD. The drain electrode of the third transistor M3 is coupled to the second node N2. The third transistor M3 is turned on when a light emission control signal is asserted on the $n^{th}$ light emission control line En, and is turned off when it is not asserted.

The first capacitor C1 is coupled between the first node N1 and the first power supply ELVDD. The first capacitor C1 is charged with a voltage corresponding to the data signal.

The compensation unit 144 is coupled between the first node N1 and the second node N2 and adjusts the voltage at the first node N1 to (partially or fully) compensate for the deterioration of the organic light emitting diode OLED. The compensation unit 144 includes a fourth transistor M5 and a second capacitor C2 serially coupled between the first node N1 and the second node N2. A drain electrode of the fourth transistor M5 is coupled to the first node N1 and a source electrode of the fourth transistor M5 is coupled to a terminal (that is, a third node N3) of the second capacitor C2. Further, a gate electrode of the fourth transistor M5 is coupled to a compensation control line CSn. The fourth transistor M5 is turned on when a compensation control signal is asserted on the compensation control line CSn and is turned off when it is not asserted.

The second capacitor C2 is coupled between the third node N3 and the second node N2. The second capacitor C2 is charged with a voltage in order to compensate for deterioration of the organic light emitting diode OLED. The second capacitor C2 generally has a capacitance smaller than that of the first capacitor C1. Voltage which is charged in the second capacitor C2 is determined according to a voltage at the anode electrode of the organic light emitting diode OLED.

Figure 4:
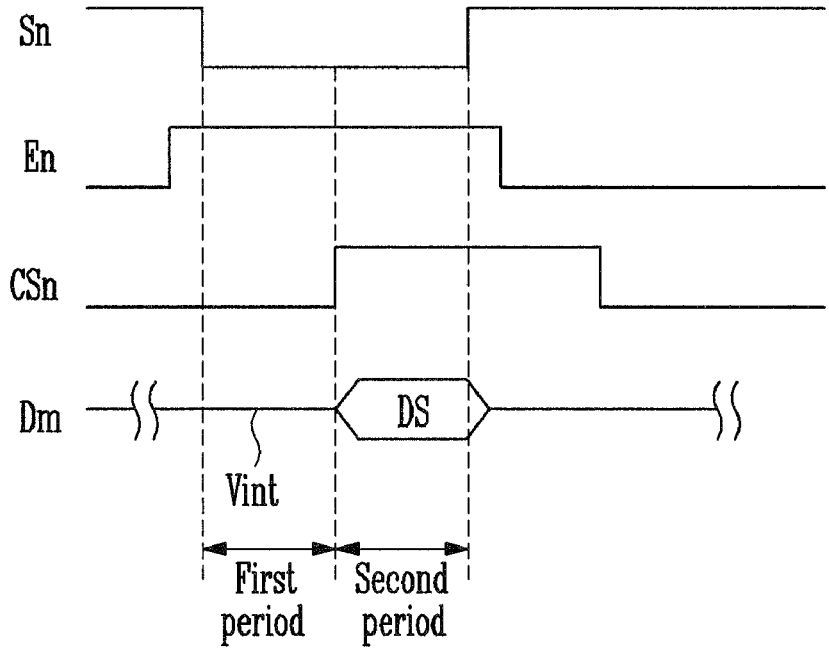
FIG. 4 is a waveform diagram showing a driving method of the pixel shown in FIG. 3.

FIG. 4 is a waveform diagram showing a method of driving the pixel shown in FIG. 3. A process of operating the pixel 140 will be described with reference to FIGS. 3 and 4. For the embodiment of FIG. 3, which uses p-channel transistors, the control signals are at low voltage levels when asserted and high voltage levels when de-asserted, as shown in FIG. 4. An alternative embodiment may use some or all n-channel transistors with corresponding changes to the controlling signals.

During the first subperiod, the light emission control signal is de-asserted on the light emission control line En, the scan signal is asserted on the scan line Sn, and the compensation control signal continues to be asserted on the compensation control line CSn. When the light emission control signal is de-asserted on the light emission control line En, the third transistor M3 is turned off. When the scan signal is asserted on the scan line Sn, the first transistor M1 is turned on. When the compensation control signal is asserted on the compensation control line CSn, the fourth transistor M5 is turned on. Also during the first subperiod, the initialization voltage is supplied on the data line Dm. Vint is supplied on the data line Dm. The initialization voltage Vint is set to a voltage capable of turning on the second transistor M2, for example, voltage lower than the data signal. Therefore, the second transistor M2 is turned on during the first subperiod so that the voltage at the anode electrode of the organic light emitting diode OLED is transferred to the second node N2. Thus, the second capacitor C2 is charged with a voltage corresponding to the difference between the initialization voltage Vint and the voltage at the anode electrode of the organic light emitting diode OLED.

When the first subperiod ends and the second subperiod begins, the compensation control signal is de-asserted on the compensation control line CSn. When the compensation control signal is de-asserted, the fourth transistor M5 is turned off. The data signal is supplied on the data line Dm during the second subperiod. The first capacitor will be charged with a voltage corresponding to the difference between the data signal and the voltage of the first power supply ELVDD.

After the first capacitor C1 is charged with the voltage corresponding to the data signal, the scan signal is de-asserted on the scan line Sn and the light emission control signal is asserted on the light emission control line En. When the scan signal is de-asserted on the scan line Sn, the first transistor M1 is turned off. When the light emission control signal is asserted on to the light emission control line En, the third transistor M3 is turned on. When the third transistor M3 is turned on, the voltage at the second node N2 rises from the voltage of the anode electrode of the organic light emitting diode OLED to the voltage of the first power supply ELVDD. The voltage at the third node N3 is changed corresponding to the voltage rise of the second node N2.

Thereafter, the compensation control signal is asserted on the compensation control line CSn. When the compensation control signal is asserted on the compensation control line CSn, the fourth transistor M5 is turned on. When the fourth transistor M5 is turned on, charge sharing occurs between the first capacitor C1 and the second capacitor C2. The resulting voltage at the first node N1 is determined by Equation 1 below:

$$V_{N1}=(C1\times V\text{data}+C2\times(ELVDD+Vint-Voled))/(C1+C2) \quad \text{[Equation 1]}$$

In Equation 1, Vdata is the voltage of the data signal, Voled is the voltage of the anode electrode of the organic light emitting diode OLED, and VN1 is the voltage at the first node N1. As seen in Equation 1, as the voltage Voled of the anode electrode of the organic light emitting diode rises, the voltage at the first node N1 drops.

As the organic light emitting diode OLED deteriorates, the voltage Voled of the anode electrode of the organic light emitting diode rises. When the voltage Voled of the anode electrode of the organic light emitting diode rises, the voltage at the first node N1, which is the gate electrode of the second transistor M2, drops. When voltage on the gate electrode of the second transistor M2 drops, a larger current is supplied to the organic light emitting diode OLED. Thus, as the organic light emitting diode OLED deteriorates, the amount of current supplied to the organic light emitting diode OLED increases, thereby compensating for brightness decrease due to the deterioration of the organic light emitting diode OLED.

Figure 5:
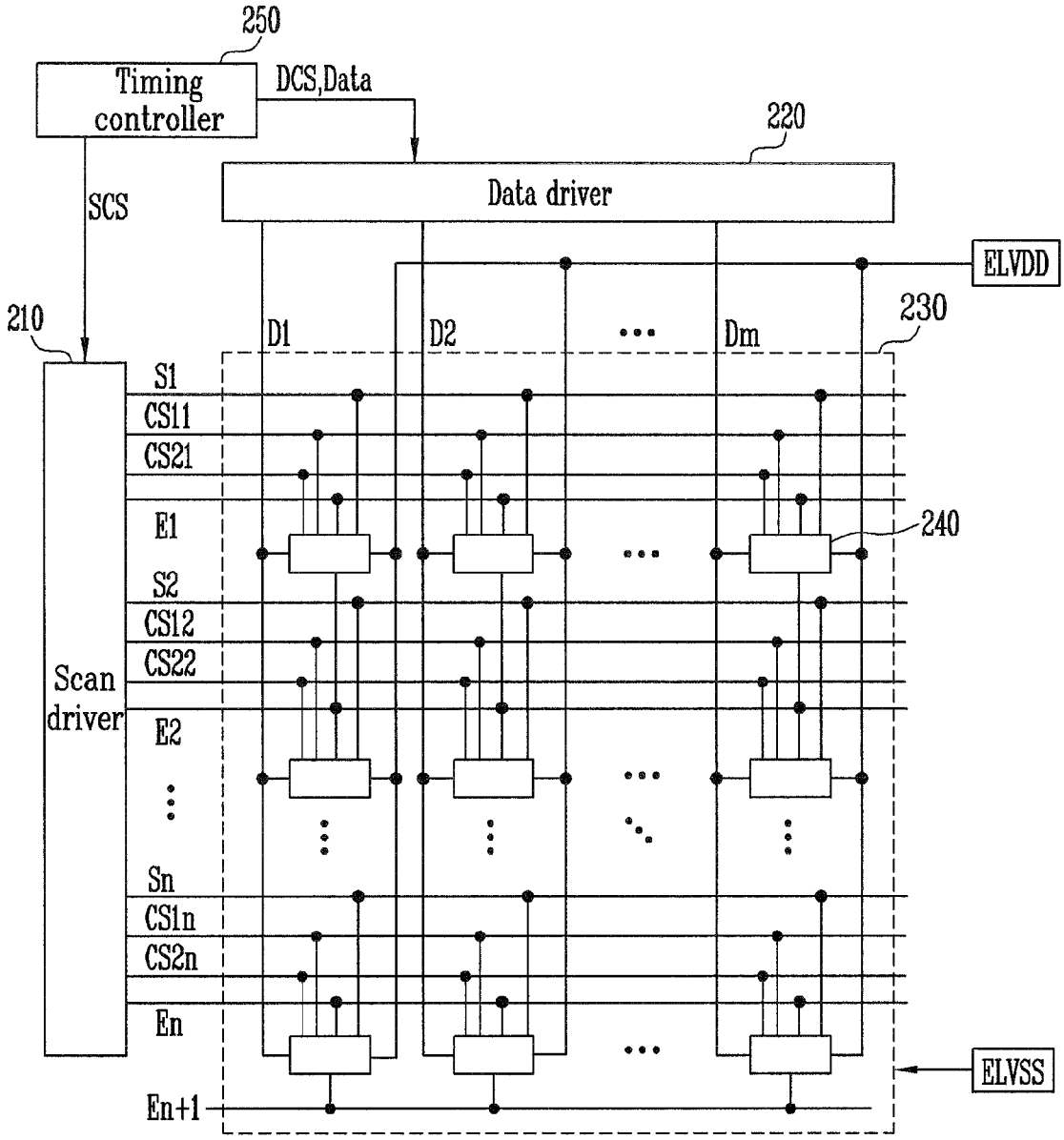
FIG. 5 is a further schematic structural view of an organic light emitting display device according to aspects of the present invention.

FIG. 5 illustrates an organic light emitting display device according to another embodiment of the present invention. As shown in FIG. 5, the organic light emitting display device includes a display area 230, a scan driver 210, a data driver 220, and a timing controller 250.

The display area 230 is coupled to the scan driver 210 by scan lines S1 to Sn, light emission control lines E1 to En, first compensation control lines CS11 to CS1*n*, and second compensation control lines CS21 to CS2*n*. The display area 230 is coupled to the data driver 220 by data lines D1 to Dm. The display area 230 includes a plurality of pixels 240 positioned at areas where the scan lines S1 to Sn, the light emission control lines E1 to En, the first compensation control lines CS11 to CS1*n*, and the second compensation control lines CS21 to CS2*n* cross the data lines D1 to Dm. The pixels 240 receive a first power ELVDD and a second power ELVSS. Each pixel 240 includes an organic light emitting diode. The pixels 240 control current supplied from the first power supply ELVDD to the second power supply ELVSS through the organic light emitting diode corresponding to a data signal. Light with a brightness corresponding to the current is generated in the organic light emitting diode.

The timing controller 250 controls the scan driver 210 and the data driver 220. The timing controller 250 generates a data driver control signal DCS and a scan driver control signal SCS corresponding to synchronization signals received by the timing controller 250. The data driver control signal DCS generated in the timing controller 250 is supplied to the data driver 220. The scan driver control signal SCS generated in the timing controller 250 is supplied to the scan driver 210. In addition, the timing controller 250 arranges data it receives and transfers them to the data driver 220.

The scan driver 210 drives the scan lines S1 to Sn, the light emission control lines E1 to En, the first compensation control lines CS11 to CS1*n*, and the second compensation control lines CS21 to CS2*n*. The scan driver 210 receives the scan driver control signal SCS and supplies signals to the scan lines S1 to Sn, the light emission control lines E1 to En, the first compensation control lines CS11 to CS1*n*, and the second compensation control lines CS21 to CS2*n*. The scan driver 210 sequentially supplies scan signals to the scan lines S1 to Sn and sequentially supplies light emission control signals to the light emission control lines E1 to En. Also, the scan driver 210 sequentially supplies first compensation control signals to the first compensation control lines CS11 to CS1*n* and sequentially supplies second compensation control signals to the second compensation control lines CS21 to CS2*n*. The scan driver supplies the signals to each of the corresponding lines during a horizontal period. Each horizontal period includes a first subperiod that precedes a second subperiod. In some embodiments, the first subperiod is set to be the same or shorter than the second subperiod. The function and timing of the signal will be described in detail below.

The data driver 220 drives the data lines D1 to Dm. The data driver receives the data driver control signal DCS and the arranged data from the timing controller 250. The data driver 220 generates data signals and supplies the generated data signals to the pixels 240 via the data lines D1 to Dm. The data driver 220 also supplies an initialization voltage for use in deterioration compensation.

Figure 6:
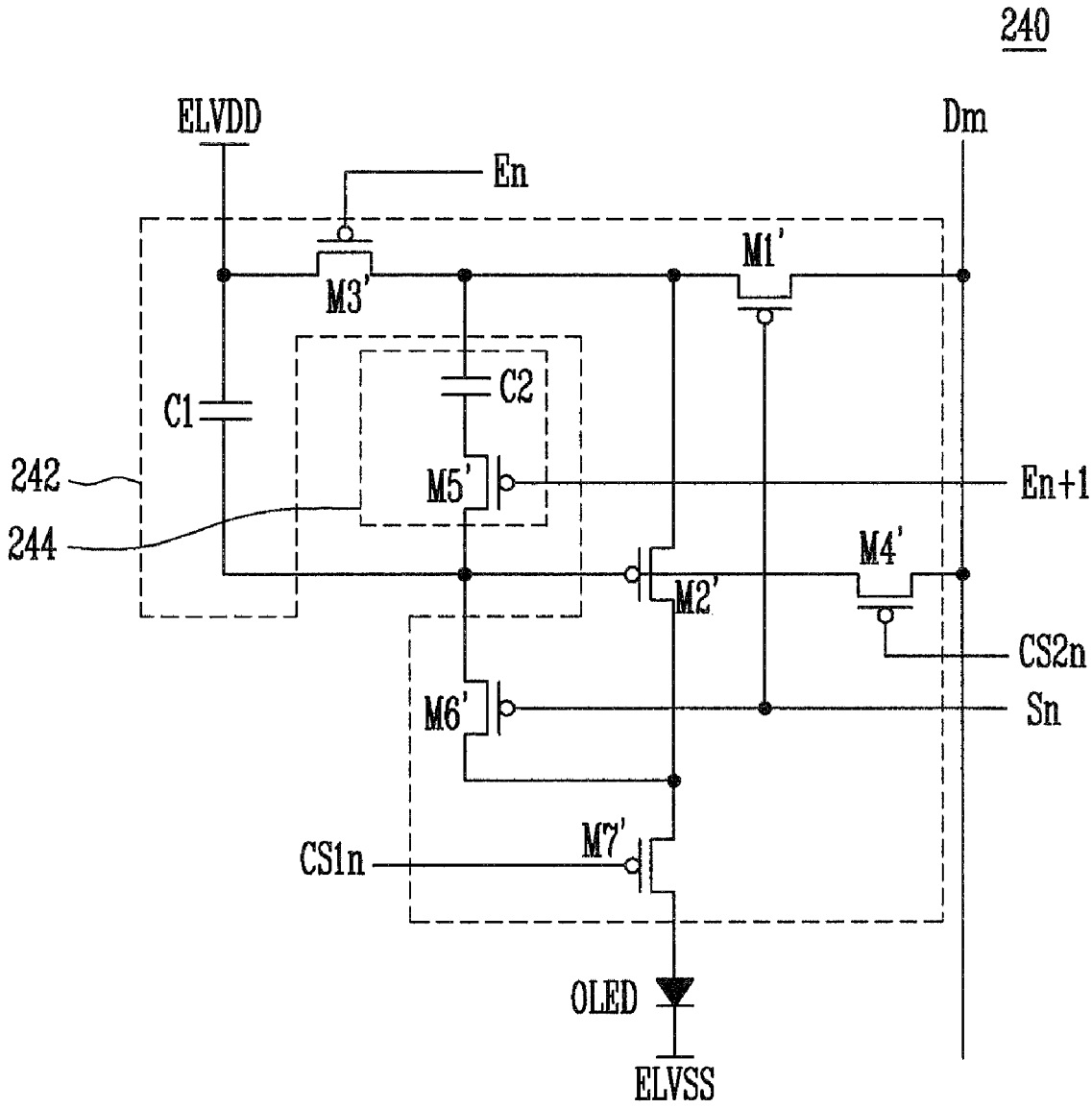
FIG. 6 is a schematic view of an embodiment of a pixel of the organic light emitting display device shown in FIG. 5.

FIG. 6 illustrates an embodiment of a pixel of the organic light emitting display shown in FIG. 5. Referring to FIG. 6, the pixel 240 includes an organic light emitting diode OLED, a pixel circuit 242 for controlling an amount of current supplied to the organic light emitting diode OLED, and a compensation unit 244 for compensating for deterioration of the organic light emitting diode OLED.

An anode electrode of the organic light emitting diode OLED is coupled to the pixel circuit 242, and a cathode electrode of the organic light emitting diode OLED is coupled to the second power supply ELVSS. The organic light emitting diode OLED generates light with a brightness corresponding to the amount of current supplied from the pixel circuit 242.

The pixel circuit 242 controls the amount of current supplied to the organic light emitting diode OLED. The pixel circuit 242 includes a first transistor M1', a second transistor M2', a third transistor M3', a fourth transistor M4', a sixth transistor M6', a seventh transistor M7', and a first capacitor C1.

The first transistor M1' has its gate electrode coupled to an $n^{th}$ scan line Sn, its source electrode coupled to an $m^{th}$ data line Dm, and its drain electrode coupled to a source electrode of the second transistor M2'. The first transistor M1' is turned on when the scan signal is asserted on the scan line Sn.

A gate electrode of the second transistor M2' is coupled to a first terminal of the first capacitor C1, and the source electrode of the second transistor M2' is coupled to the drain electrode of the first transistor M1'. A drain electrode of the second transistor M2' is coupled to a source electrode of the seventh transistor M7'. The second transistor M2' controls current flowing from the first power supply ELVDD to the second power supply ELVSS through the organic light emitting diode OLED corresponding to a voltage with which the first capacitor C1 is charged.

A gate electrode of the third transistor M3' is coupled to an $n^{th}$ light emission control line En, and a source electrode of the third transistor M3' is coupled to the first power supply ELVDD. A drain electrode of the third transistor M3' is coupled to the source electrode of the second transistor M2'. The third transistor M3' is turned on when a light emission control signal is asserted on the $n^{th}$ light emission control line En, and is turned off when it is not asserted.

The fourth transistor M4' has its gate electrode coupled to a second compensation control line CS2*n*, its drain electrode coupled to the gate electrode of the second transistor M2', and its source electrode coupled to the data line Dm. When a second compensation control signal is asserted on the second compensation control line CS2*n*, the fourth transistor M4' is turned on to transfer the initialization voltage supplied on the data line Dm to the gate electrode of the second transistor M2'.

The sixth transistor M6' has its drain electrode coupled to the drain electrode of the second transistor M2', its source electrode coupled to the gate electrode of the second transistor M2', and its gate electrode coupled to the $n^{th}$ scan line Sn.

When the scan signal is asserted on the $n^{th}$ scan line Sn, the sixth transistor M6' is turned on to couple the second transistor M2' in a diode form.

The seventh transistor M7' is coupled between the drain electrode of the second transistor M2' and the anode electrode of the organic light emitting diode OLED. The seventh transistor M7' is turned on when the first compensation control signal is asserted on the first compensation control line CS1*n* and is turned off when it is not asserted.

The first capacitor C1 is coupled between the gate electrode of the second transistor M2' and the first power supply ELVDD. The first capacitor C1 is charged with a voltage corresponding to the data signal and threshold voltage of the second transistor M2'.

The compensation unit 244 is coupled between the gate electrode and the source electrode of the second transistor M2' and adjusts the voltage of the gate electrode of the second transistor M2' to (partially or fully) compensate for the deterioration of the organic light emitting diode OLED. The compensation unit 244 includes a fifth transistor M5' and a second capacitor C2 serially coupled between the gate electrode and the source electrode of the second transistor M2'.

The fifth transistor M5' has its drain electrode coupled to the gate electrode of the second transistor M2', its source electrode coupled to a first terminal of the second capacitor C2, and its gate electrode coupled to an $n+1^{th}$ light emission control line En+1. The fifth transistor M5' is turned on when a light emission control signal is asserted on the $n+1^{th}$ light emission control line En+1, and is turned off when it is not asserted.

A second terminal of the second capacitor C2 is coupled to the source electrode of the fifth transistor M5'. A voltage charged on the second capacitor is used to compensate for deterioration of the organic light emitting diode OLED.

Figure 7:
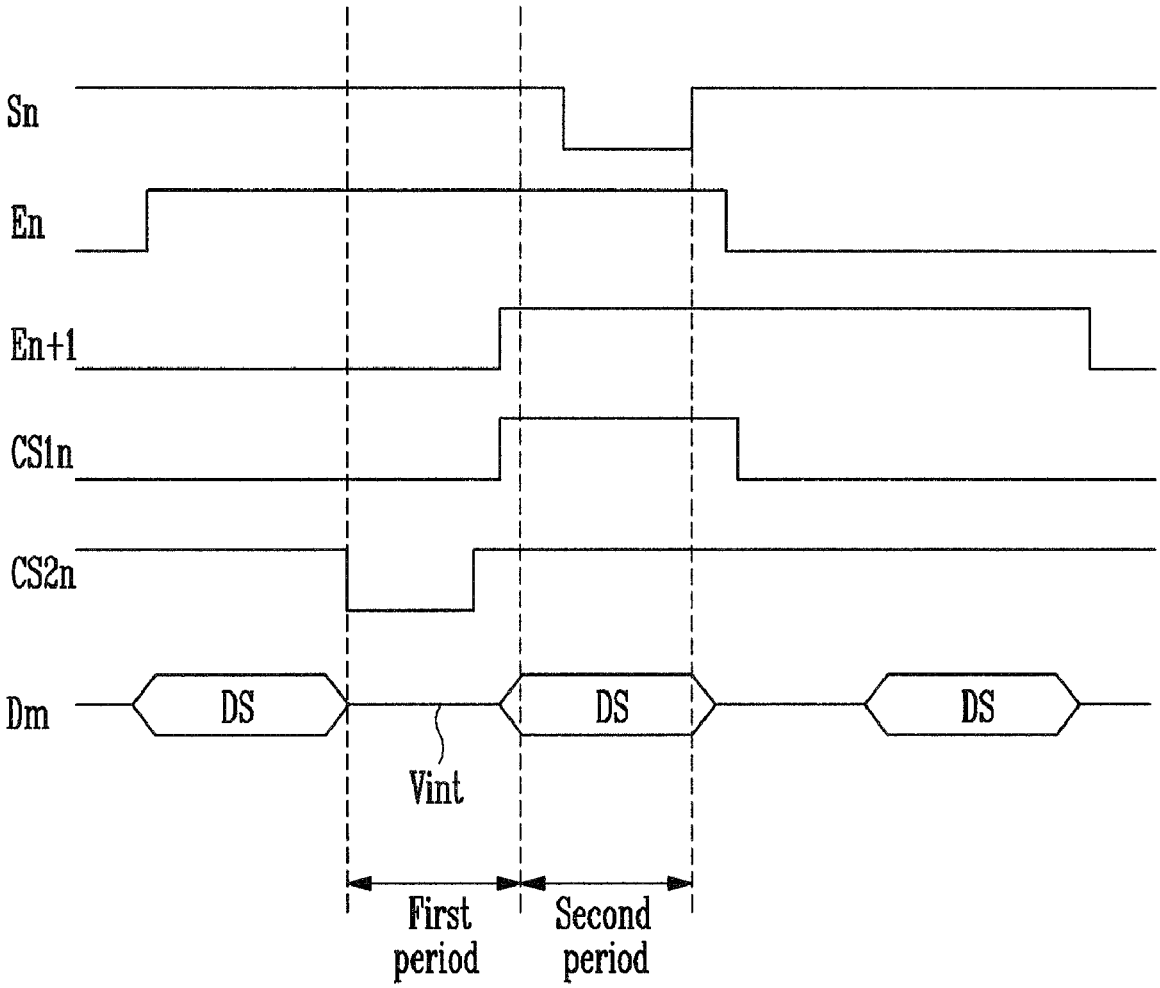
FIG. 7 is a waveform diagram showing a driving method of the pixel shown in FIG. 6.

FIG. 7 is a waveform diagram showing a driving method of the pixel shown in FIG. 6. A process of operating the pixel 240 will be described with reference to FIGS. 6 and 7.

First, the light emission control signal is de-asserted on the $n^{th}$ light emission control line En. This turns off the third transistor M3'. Thereafter, during the first subperiod of the horizontal period during which the pixels coupled to scan line Sn are accessed, the second compensation control signal is asserted on the second compensation control line CS2*n*. When the second compensation control signal is asserted, the fourth transistor M4' is turned on. When the fourth transistor M4' is turned on, the initialization voltage Vint supplied on the data line Dm is transferred to the gate electrode of the second transistor M2'. At this time, the second transistor M2' is turned on so that the voltage at the anode electrode of the organic light emitting diode OLED is transferred to the second terminal of the second capacitor C2. Since the fifth transistor M5' is turned on, the initialization voltage is supplied to the first terminal of the second capacitor C2. Accordingly, the second capacitor C2 is charged with a voltage corresponding to the difference between the initialization voltage Vint and the voltage on the anode electrode of the organic light emitting diode OLED.

Thereafter, during the second subperiod of a horizontal period during which the pixels coupled to scan line Sn are selected, the scan signal is asserted on the scan line Sn, the light emission control signal is de-asserted on the $n+1^{th}$ light emission control line En+1, the first compensation control signal is de-asserted on the first compensation control line CS1*n*, and the second compensation control signal is de-asserted on the second compensation control line CS2*n*. When the second compensation control signal is de-asserted on the second compensation control line CS2*n*, the fourth transistor M4' is turned off. When the scan signal is asserted on to the scan line Sn, the first transistor M1' and the sixth transistor M6' are turned on. When the light emission control signal is de-asserted on the $n+1^{th}$ light emission control line En+1, the fifth transistor M5' is turned off. When the first compensation control signal is de-asserted on the first compensation control signal CS1*n*, the seventh transistor M7' is turned off.

When the first transistor M1' is turned on, the data signal supplied on the data line Dm is transferred to the first electrode of the second transistor M2'. When the sixth transistor M6' is turned on, the second transistor M2' is coupled in a diode form. Since the gate electrode of the second transistor M2' is initialized with the initialization voltage Vint, the second transistor M2' is turned on when the data signal is a higher voltage. Accordingly, the data signal supplied from the data line Dm is coupled to the first capacitor C1 via the second transistor M2' and the sixth transistor M6'. Thus, the first capacitor C1 is charged with a voltage corresponding to the data signal and threshold voltage of the second transistor M2'. At this time, the voltage of the gate electrode of the second transistor M2' is Vdata−|Vth| (the threshold voltage of the second transistor M2').

After the second subperiod of a horizontal period during which the pixels coupled to scan line Sn are accessed, the scan signal is de-asserted on the $n^{th}$ scan line Sn, the light emission control signal is asserted on the $n^{th}$ light emission control line En, and the first compensation control signal is asserted on the first compensation control line CS1.

When the light emission control signal is asserted on the $n^{th}$ light emission control line En, the third transistor M3' is turned on. When the scan signal is de-asserted on the $n^{th}$ scan line Sn, the first transistor M1' and the sixth transistor M6' are turned off. When the first compensation control signal is asserted on the first compensation control line CS1*n*, the seventh transistor M7' is turned on.

When the third transistor M3' is turned on, the voltage of the second terminal of the second capacitor C2 rises from the voltage of the anode electrode of the organic light emitting diode OLED to the voltage of the first power supply ELVDD. The voltage of the first terminal of the second capacitor C2 rises by an amount corresponding to the voltage rise in the second terminal. Thus, the voltage of the first terminal of the second capacitor C2 is changed to the voltage of ELVDD+Vint−Voled.

Thereafter, the light emission control signal is asserted on the $n+1^{th}$ light emission control line En+1. This turns the fifth transistor M5' on. When the fifth transistor M5' is turned on, charge sharing occurs between the first capacitor C1 and the second capacitor C2. The resulting voltage of the gate electrode of the second transistor M2' is determined by Equation 2 below:

$$Vgate=(C1\times Vdata-Vth|)+C2\times(ELVDD+Vint-Voled))/(C1+C2) \quad \text{[Equation 2]}$$

In Equation 2, Vgate is the voltage of the gate electrode of the second transistor M2'. Referring to the Equation 2, as the voltage Voled of the anode electrode of the organic light emitting diode rises, the voltage of the gate electrode of the second transistor M2' drops. Therefore, as the organic light emitting diode OLED deteriorates, the current supplied to the organic light emitting diode OLED is increased, thereby compensating for brightness decrease due to the deterioration of the organic light emitting diode OLED.

While the present invention has been described in connection with certain exemplary embodiments, it is to be understood that the invention is not limited to the disclosed embodiments, but, on the contrary, is intended to cover various modifications and equivalent arrangements included within the spirit and scope of the appended claims, and equivalents thereof.

What is claimed is:

1. An organic light emitting display device, comprising:

a scan driver configured to drive scan lines, first control lines, and light emission control lines;

a data driver configured to supply initialization voltages to data lines during a first subperiod of a horizontal period and configured to supply data signals to the data lines during a second subperiod of the horizontal period; and pixels positioned at crossing areas of the scan lines and the data lines, each of the pixels comprising:

an organic light emitting diode;

a pixel circuit comprising a first transistor for controlling an amount of current flowing from a first power supply through the organic light emitting diode to a second power supply, the first transistor configured to receive the initialization voltage at its gate electrode during the first subperiod; and a compensation unit coupled between the gate electrode and a source electrode of the first transistor, the compensation unit configured to control voltage at the gate electrode of the first transistor corresponding to a deterioration of the organic light emitting diode, the compensation unit comprising a second transistor and a first capacitor serially coupled between the gate electrode and the source electrode of the first transistor.

2. The organic light emitting display device as claimed in claim 1, wherein the scan driver is configured to turn off the second transistor during the second subperiod.

3. The organic light emitting display device as claimed in claim 1, wherein the pixel circuit and the compensation unit are configured to charge the first capacitor with a voltage depending on a voltage on an anode electrode of the organic light emitting diode.

4. The organic light emitting display device as claimed in claim 1, wherein the initialization voltage is set so that the first transistor is turned on during the first subperiod.

5. The organic light emitting display device as claimed in claim 1, wherein the scan driver is configured to sequentially assert scan signals on the scan lines during the first and second subperiods of the horizontal period, is configured to de-assert a first control signal on an $i^{th}$ first control line overlapped with the scan signal asserted on an $i^{th}$ scan line during the second subperiod, and is configured to de-assert a light emission control signal on an $i^{th}$ light emission control line overlapped with the scan signal asserted on the $i^{th}$ scan line.

6. The organic light emitting display device as claimed in claim 5, wherein the pixel circuit further comprises:

a second capacitor coupled between the gate electrode of the first transistor and the first power supply, a third transistor coupled between the source electrode of the first transistor and the first power supply, the third transistor configured to be turned off when the light emission control signal is de-asserted on the $i^{th}$ light emission control line, and a fourth transistor coupled between the data line and the gate electrode of the first transistor and configured to be turned on when the scan signal is asserted on the $i^{th}$ scan line.

7. The organic light emitting display device as claimed in claim 6, wherein the capacitance of the second capacitor is greater than the capacitance of the first capacitor.

8. The organic light emitting display device as claimed in claim 5, wherein the second transistor is configured to be turned off when the control signal is de-asserted on the $i^{th}$ first control line.

9. The organic light emitting display device as claimed in claim 1, wherein the scan driver is configured to sequentially assert scan signals on the scan lines during the second subperiod of the horizontal period, is configured to de-assert a light emission control signal on an $i^{th}$ light emission control line overlapped with the scan signals asserted on an $i^{th}$ scan line and an $i-1^{th}$ scan line, and is configured to de-assert a first control signal on an $i^{th}$ first control line overlapped with the scan signal asserted on the $i^{th}$ scan line.

10. The organic light emitting display device as claimed in claim 9, wherein the scan driver is configured to sequentially assert second control signals to second control lines every first subperiod of the horizontal period, where each of the second control lines is coupled to the pixels that are coupled to a corresponding one of the scan lines.

11. The organic light emitting display device as claimed in claim 10, wherein the pixel circuit comprises:

a second capacitor coupled between the gate electrode of the first transistor and the first power supply, a third transistor coupled between the source electrode of the first transistor and the first power supply and configured to be turned off when the light emission control signal is de-asserted on the $i^{th}$ light emission control line, a fourth transistor coupled between the data line and the source electrode of the first transistor and configured to be turned on when the scan signal is asserted on the $i^{th}$ scan line, a fifth transistor coupled between the gate electrode of the first transistor and the data line and configured to be turned on when the second control signal is asserted on an $i^{th}$ second control line, a sixth transistor coupled between the gate electrode and a drain electrode of the first transistor and configured to be turned on when the scan signal is asserted on the $i^{th}$ scan line, and a seventh transistor coupled between the drain electrode of the first transistor and the organic light emitting diode and configured to be turned off when the first control signal is de-asserted on the $i^{th}$ first control line.

12. An organic light emitting display device, comprising:

a plurality of pixels, each of the pixels coupled to a first power source, a second power source, a scan line for receiving a scan signal, a control line for receiving a control signal, a data line for receiving data voltages and initialization voltages, and an emission control line for receiving emission control signals, and each of the pixels comprising:

an organic light emitting diode coupled to the second power source;

a compensation unit comprising a first storage element for storing a first voltage of a voltage difference between the initialization voltage and a voltage across the organic light emitting diode; and a pixel circuit comprising a second storage element for storing the data voltages and a drive transistor coupled to the organic light emitting diode, wherein the first storage element and the second storage element are coupled in parallel in response to the emission control signal and the control signal between a first electrode and a gate electrode of the drive transistor, such that a current flowing in the organic light emitting diode is based on both the data voltage and the stored voltage across the organic light emitting diode.

13. The organic light emitting display device of claim 12, wherein the second storage element stores the data voltages in response to the scan signal.

14. The organic light emitting display device of claim 12, wherein the first storage element stores the first voltage in response to the scan signal and the control signal.

15. An organic light emitting display device, comprising:

a plurality of pixels, each of the pixels coupled to a first power source, a second power source, a scan line for receiving a scan signal, a first control line for receiving a first control signal, a second control line for receiving a second control signal, a data line for receiving data voltages and initialization voltages, an $i^{th}$ emission control line for receiving emission control signals, and an $i+1^{th}$ emission control line for receiving the emission control signals, and each of the pixels comprising:

an organic light emitting diode coupled to the second power source;

a compensation unit comprising a first storage element for storing a first voltage of a voltage difference between the initialization voltage and a voltage across the organic light emitting diode; and a pixel circuit comprising a drive transistor coupled to the organic light emitting diode and a second storage element for storing a second voltage of a voltage difference between the data voltage and a threshold voltage of the drive transistor wherein the first storage element and the second storage element are coupled in parallel in response to the $i^{th}$ emission control signal and the $i+1^{th}$ emission control signal between a first electrode and a gate electrode of the drive transistor, such that a current flowing in the organic light emitting diode is based on the data voltage, the stored voltage across the organic light emitting diode, and the stored threshold voltage of the drive transistor.

16. The organic light emitting display device of claim 15, wherein the second storage element stores the second voltage in response to the scan signal.

17. The organic light emitting display device of claim 15, wherein the first storage element stores the first voltage in response to a first control signal, a second control signal, and an $i+1^{th}$ emission control signal.

* * * * *